US006276988B1

(12) United States Patent
Chen

(10) Patent No.: US 6,276,988 B1
(45) Date of Patent: Aug. 21, 2001

(54) FULLY AUTOMATIC SCRAPPER GRINDER

(76) Inventor: Tung-Chin Chen, No. 65, Wuchuen 7th Road, Wuku Industrial Area, Taipei Hsien (TW)

( * ) Notice: Subject to any disclaimer, the term of this patent is extended or adjusted under 35 U.S.C. 154(b) by 0 days.

(21) Appl. No.: 09/479,625

(22) Filed: Jan. 7, 2000

(51) Int. Cl.[7] ..... B24B 7/02
(52) U.S. Cl. ..... 451/5; 451/124; 451/150
(58) Field of Search ..... 451/124, 5, 141, 451/150–152, 456

(56) References Cited

U.S. PATENT DOCUMENTS 3,872,627 * 3/1975 Schuster ..... 451/456 X
4,055,918 * 11/1977 Bralander et al. ..... 451/150 X
4,694,613 * 9/1987 Bernhard ..... 451/150

* cited by examiner

*Primary Examiner*—Derris H. Banks
*Assistant Examiner*—Anthony Ojini
(74) *Attorney, Agent, or Firm*—Dougherty & Troxell

(57) ABSTRACT

This specification discloses an improved fully automatic scraper grinder, which is modified from a conventional semi-automatic model. It comprises an emery wheel base, a set of upper and lower fine tuning devices driven by a motor provided thereon, and a set of front and back two-step displacement device driven by a cylinder. By incorporating a specially designed emery wheel with two different sizes of emery on the front and back, the emery wheel can provide a set of fully automatic grinding procedure that can first roughly grind then finely grind according to different scrapers using a digital control system so as to achieve a highly efficient automatic grinding. Furthermore, a worm type angle adjuster is provided on a scraper holder for adjusting the angle of the scraper holder, an automatic switching aspirator is provided on the emery wheel base for automatic switches to single sided air intake in the reciprocating motion of the emery wheel to remove the dusts produced by the scraper grinding. So the whole grinder possesses novelty and practical values.

6 Claims, 12 Drawing Sheets

FULLY AUTOMATIC SCRAPPER GRINDER

BACKGROUND OF THE INVENTION

1. Field of Invention

The present invention relates an improved fully automatic scraper grinder and, in particular, to a grinder that comprises an emery wheel base, a set of upper and lower fine tuning devices driven by a motor provided thereon, and a set of front and back two-step displacement device driven by a cylinder. By incorporating a specially designed emery wheel with two different sizes of emery on the front and back, the emery wheel can provide a set of fully automatic grinding procedure that can first roughly grind then finely grind according to different scrapers using a digital control system. Furthermore, a worm type angle adjuster is provided on a scraper holder for adjusting the angle of the scraper holder, an automatic switching aspirator is provided on the emery wheel base for automatic switches to single sided air intake in the reciprocating motion of the emery wheel to remove the dusts produced by the scraper grinding.

2. Related Art

Since currently all scraper (i.e., the ink scraper used in the halftone printing) grinders in the world are of the semi-automatic type; namely, an operator has to operate and monitor while grinding so as to control the scraper in an automatic cycle of the emery wheel. Furthermore, currently used grinding wheels are emery wheels or emery stripes. It is very lately that a U.S. made diamond emery wheel is available. However, since scrapers need to be finely ground, small diamond particles have to be employed. Each time the scraper is inserted into the emery wheel with diamond granules by 0.1 to 0.2 mm. If the scraper is inserted too much, then the grinding surface would be overheated so that the scraper or dusts become sticky and affect the quality of the scraper and the grinding surface of the emery wheel. Nevertheless, each scraper has 0.2 to 10 mm to be ground, so the scraper has to be inserted several times to complete the whole grinding process. This is a very time-wasting and tiring job, which is one defect of the conventional scraper grinder.

Moreover, dusts will be produced while grinding the scraper. Therefore, the scraper grinder is always provided with a dust remover. Since the scraper is ground by moving the emery wheel sideways reciprocally, the emery wheel motor also switches its rotational directions in this reciprocal process. When the emery wheel grinds in one direction, the dusts are exhausted to the other. So the air intake pipe of the conventional dust aspirator has a main sucking pipe that is divided into two side pipes on both sides of the emery wheel and sucking at the same time. The suction is thus divided in halves and appears to be insufficient. It can roughly obtain 60% of the dust removing effect, which is another defect of the conventional scraper grinder.

The scraper grinder is equipped with a scraper holder, which can be turned and adjusted to a proper grinding angle. Yet, conventionally the angle adjustment of the scraper holder is done manually. When the holder is too long or the operator is female, it is hard to hold and operate, which in turn affect the precision of the scraper grinding angle. This is the other defect of the conventional scraper grinder.

SUMMARY OF THE INVENTION

In view of the foregoing disadvantages, the instant invention provides an improved fully automatic scrape grinder, which comprises an emery wheel base, a set of upper and lower fine tuning devices driven by a motor provided thereon, and a set of front and back two-step displacement device driven by a cylinder. By incorporating a specially designed emery wheel with two different sizes of emery on the front and back, the emery wheel can provide a set of fully automatic grinding procedure that can first roughly grind then finely grind according to different scrapers using a digital control system.

Another object of the present invention is to provide an improved fully automatic scraper grinder, which comprises a worm type angle adjuster on a scraper holder for adjusting the angle of the scraper holder by rotating a wheel. The worm of the same axis then drives a corresponding worm wheel so that the angle of the scraper holder connected thereon can be adjusted. An angle gauge is also provided for visual adjustment.

Furthermore, the instant invention provides an improved fully automatic scraper grinder, which further comprises an automatic switching aspirator on the emery wheel base for automatic switches to single sided air intake in the reciprocating motion of the emery wheel to remove the dusts produced by the scraper grinding.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1:
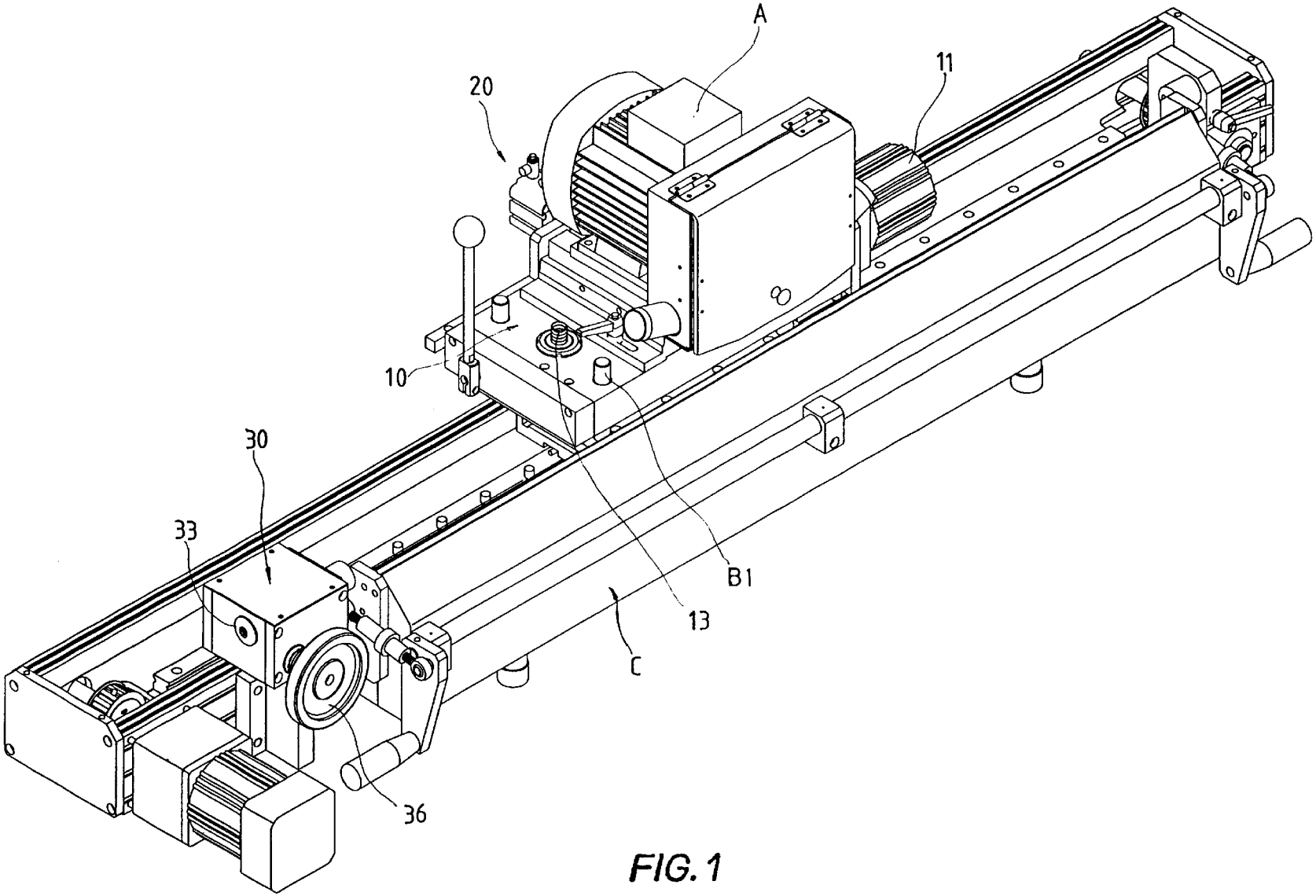
FIG. 1 is a three dimensional front view of the structure of the present invention.
Figure 2:
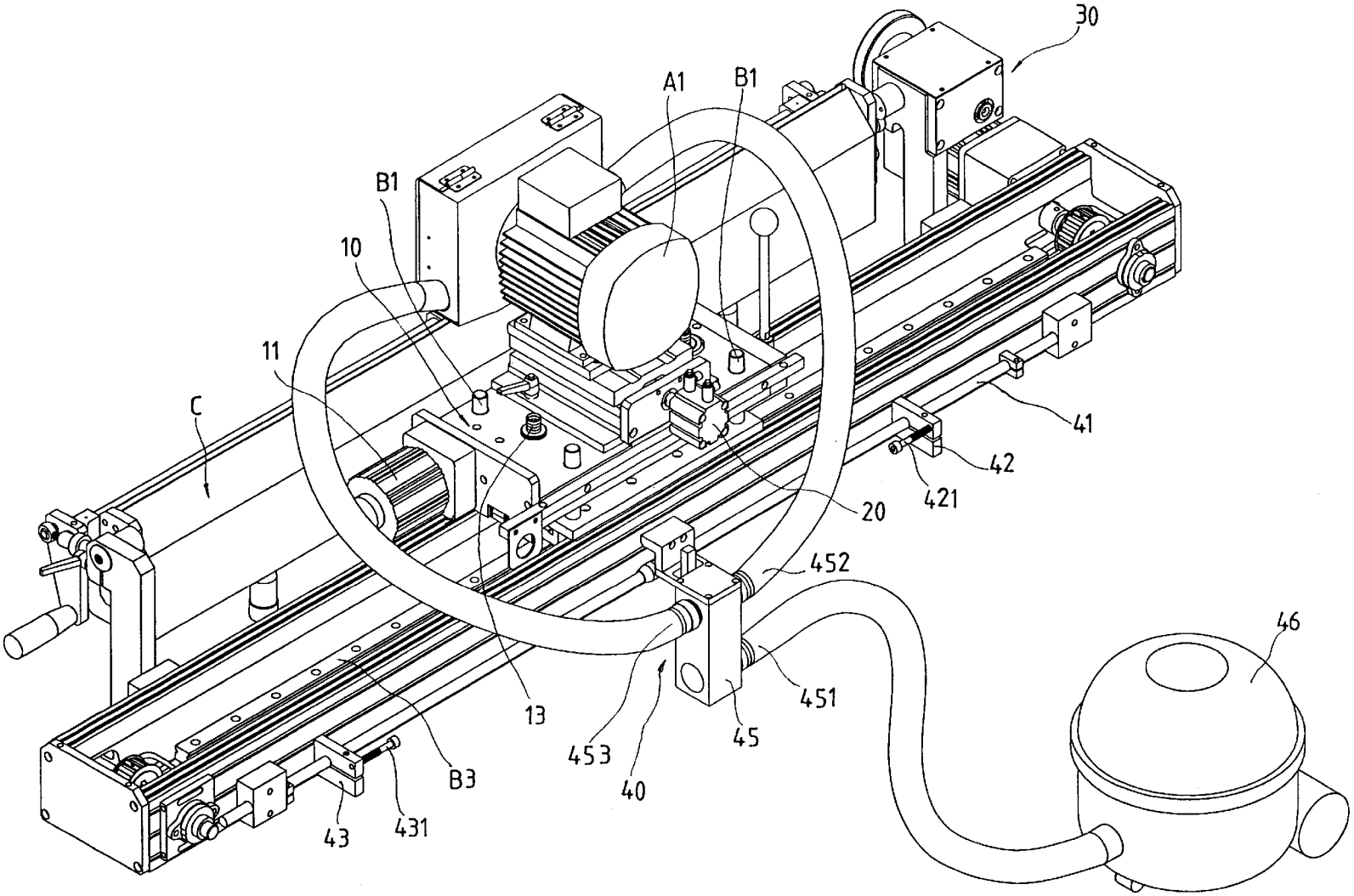
FIG. 2 is a three dimensional back view of the structure of the present invention.
Figure 3:
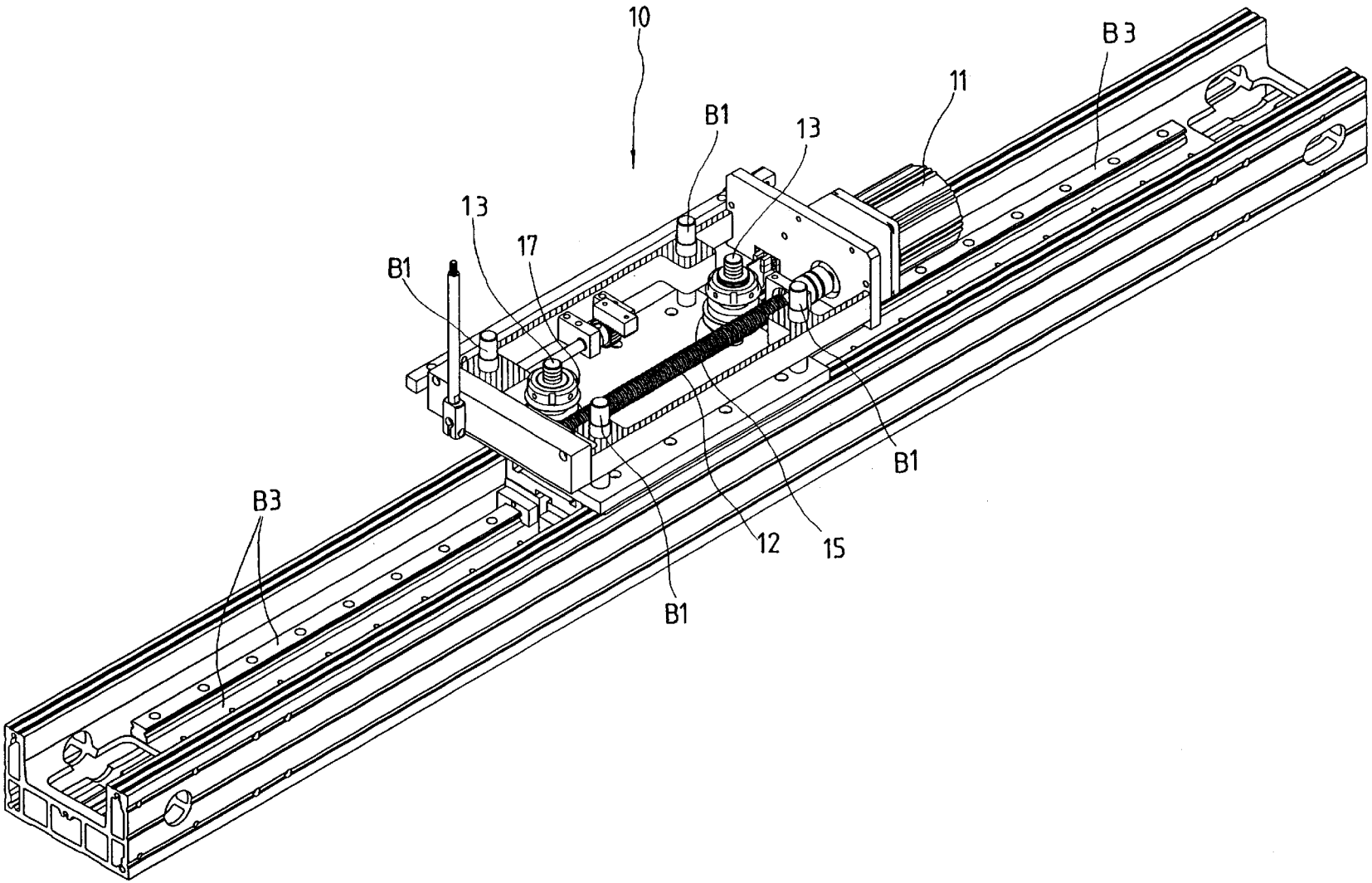
FIG. 3 is a three dimensional cross sectional view of the upper and lower fine tuning devices of the present invention.
Figure 4:
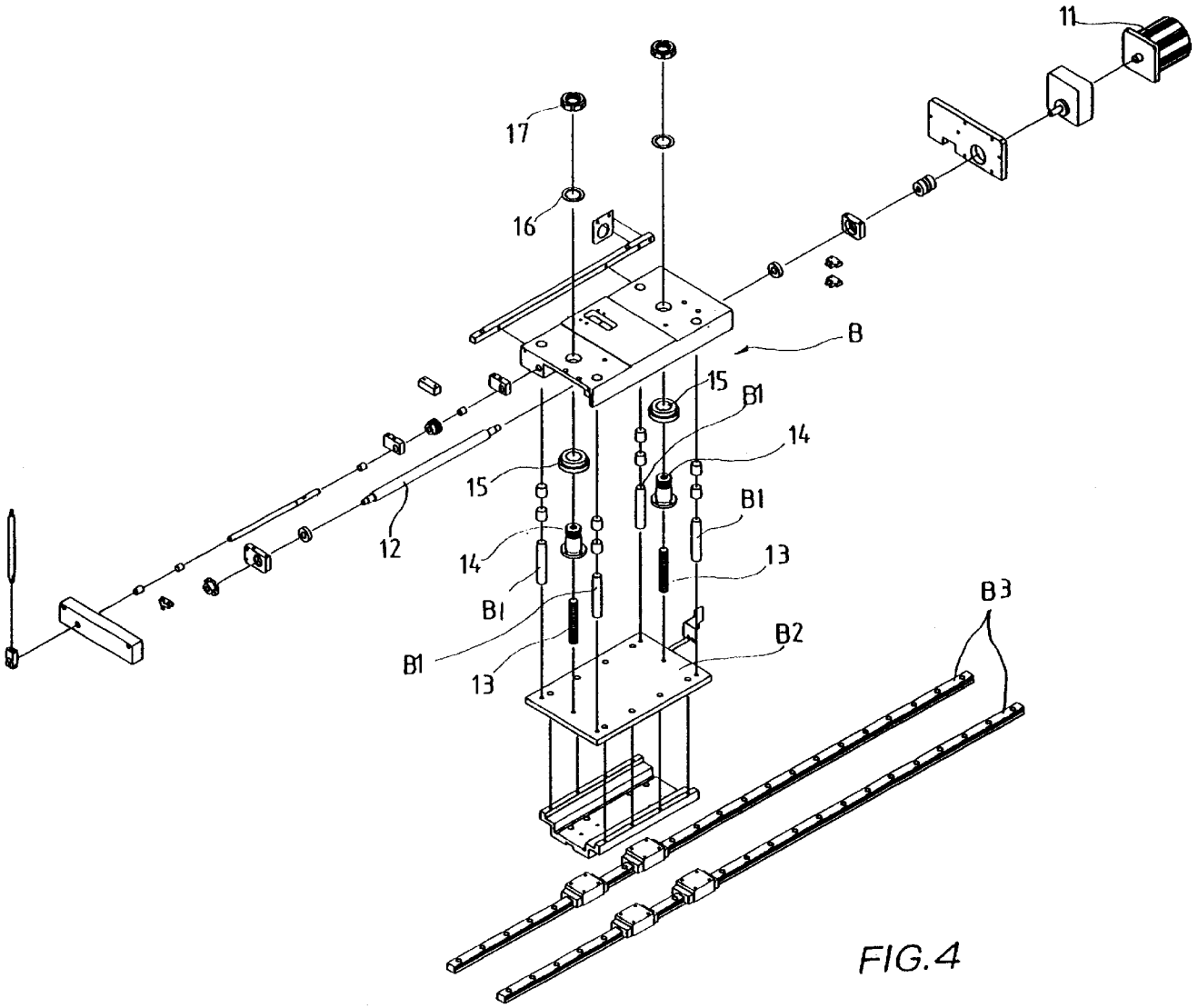
FIG. 4 is a three dimensional local exposed view of the upper and lower fine tuning devices of the present invention.

Referring to FIGS. 1 and 2, the invention comprises a set of upper and lower fine tuning devices 10 driven by a motor, a set of front and back two-step displacement device 20 driven by a cylinder, a set of angle adjuster 30, and a set of automatic switching aspirator 40. These main structures are installed on a base firmly fixed on the ground (not shown). A digital control system panel 50 is provided at a proper position on the base for the operators to operate.

Please refer to FIGS. 1, 2, 3 and 4. The upper and lower fine tuning devices 10 are provided under a emery wheel base A and in an adjuster B. It comprises a motor 11 disposed sideways, the power of the motor 11 is transmitted to a long worm beam 12 through a decelerator. The long worm beam 12 is formed in the adjuster B and can rotate in steadily. The adjuster B is formed on four beams B1 and can slide ups and downs thereby. The four beams B1 are fixed on a beam plate B2 and come out of the adjuster B. The beam plate B2 can be driven to reciprocally slide along tracks B3. Two fine tuning bolts 13 are provided symmetrically over the beam plate B2 and come out of the adjuster B. Each of the fine tuning bolts 13 is coupled with a fine tuning nut 14, which is formed with a worm wheel 15 that extends from below through the adjuster B. Each of them is assembled with a plastic steel 16 and a sunny nut 17 into a single body. In particular, the symmetrically disposed two worm wheels 15 are coupled with the long worm beam 12 and driven synchronously. The two individual bodies consisted of the fine tuning nuts 14, the worm wheels 15, the plastic steels 16, and the sunny nuts 17 rotate with the two fine tuning bolts. Since the two fine tuning bolts 13 are fixed on the beam plate B2, the synchronously rotating two individual bodies then drive the adjuster B to slide along the four beams B1. The sliding direction is determined by the forward and backward rotation of the motor 11 on the worm beam 12. In other words, by the upper and lower fine tuning devices 10, the emery wheel base A can be precisely controlled to slide ups and downs using a digital control system.

Figure 5:
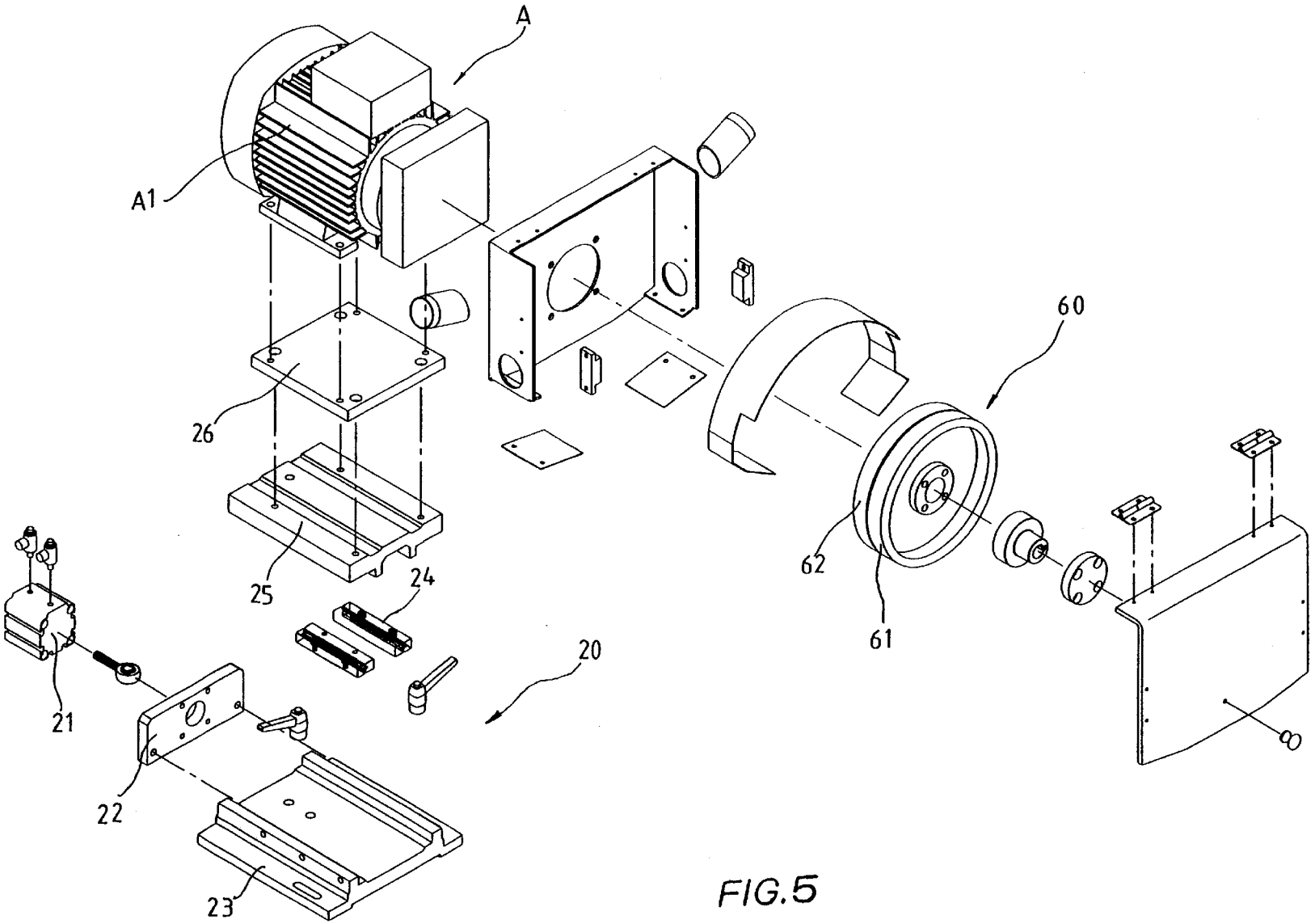
FIG. 5 is a three dimensional exposed view of a front-and-back two-step displacement device of the present invention.

Please refer to FIGS. 1, 2, and 5. The front and back two-step displacement device 20 is provided under the emery wheel base A and above the adjuster B. It comprises a ultra-thin cylinder 21 disposed in the forward direction and on a cylinder base 22, which is further fixed on a motor adjuster 23 on the adjuster B. The motor adjuster 23 connects to a motor slider base 25 using a set of forward and backward tracks 24. The cylinder 21 can drive the motor slider base 25 to steadily slide on the motor adjuster 23. The motor slider base 25 can be fixed with the motor A1 in the emery wheel base A. The emery wheel base A can be driven by the cylinder 21 and steadily slide on the motor adjuster 23. In other words, with the front and back two-step displacement device 20, the emery wheel base A can precisely displace and slide using a digital control system.

Figure 6:
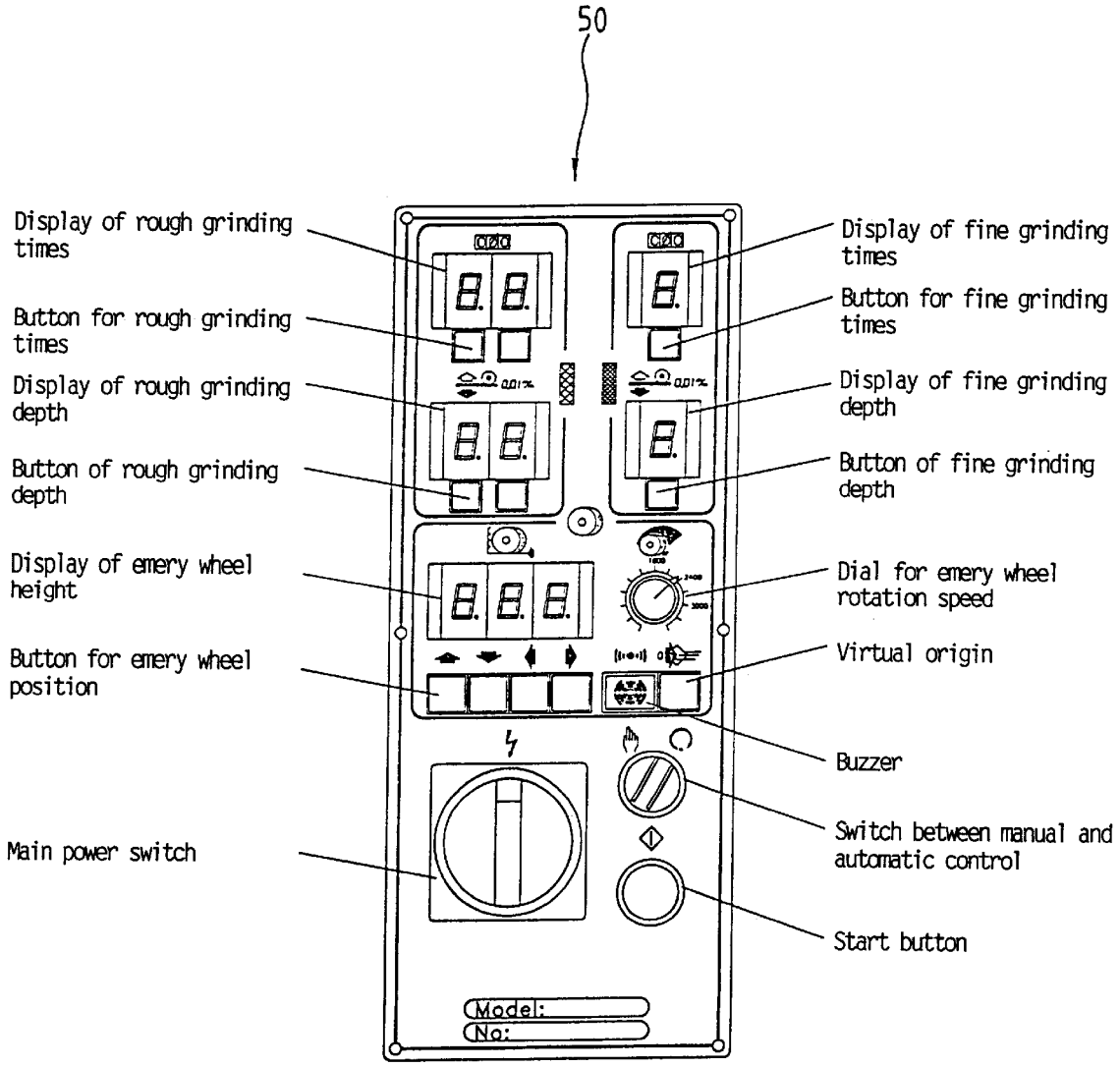
FIG. 6 is a planar reference diagram of a digital control system panel of the present invention.

When in use, the emery wheel base A achieves highly efficient automatic grinding, with a digital control system, using the upper and lower fine tuning devices 10 driven by the motor 11, the front and back two-step displacement device 20 driven by a cylinder 21, and a special diamond emery wheel 60 with two different sizes of granules. Since a digital control system is employed, one end can be set as the initial end, and the scraper insertion vertically or back and forth is controlled by the initial end too. Each grinding procedure comprises forward and backward strokes. In the forward stroke, the diamond emery wheel 60 rotate in the reversed direction. The control process is as follows: First, rough grinding is chosen. Since the size of the rough granule on the diamond emery wheel 60 is larger, the scraper can be inserted into by 0.5 mm without overheating or causing sticky dusts. Referring to FIG. 6, one can set the amount of scraper insertion and grinding times on the digital control system panel 50 according to the hardness, material of the scraper. When the grinding procedure is completed, the system panel 50 shows a signal and the next procedure is automatically executed. That is, by pushing the emery wheel base A forward with the front and back two-step displacement device 20, the fine granule surface 62 on the diamond emery wheel 60 is shifted to the grinding surface of the scraper. The grinding procedure is further continued according to predetermined settings of fine grinding amount and times. The whole procedure is fully automatic and does not need manual operation. The scraper insertion amount in each rough and fine grinding and times of grinding are arranged in the best setting, which can not only increase the grinding quality but also save a lot of human power.

Figure 7:
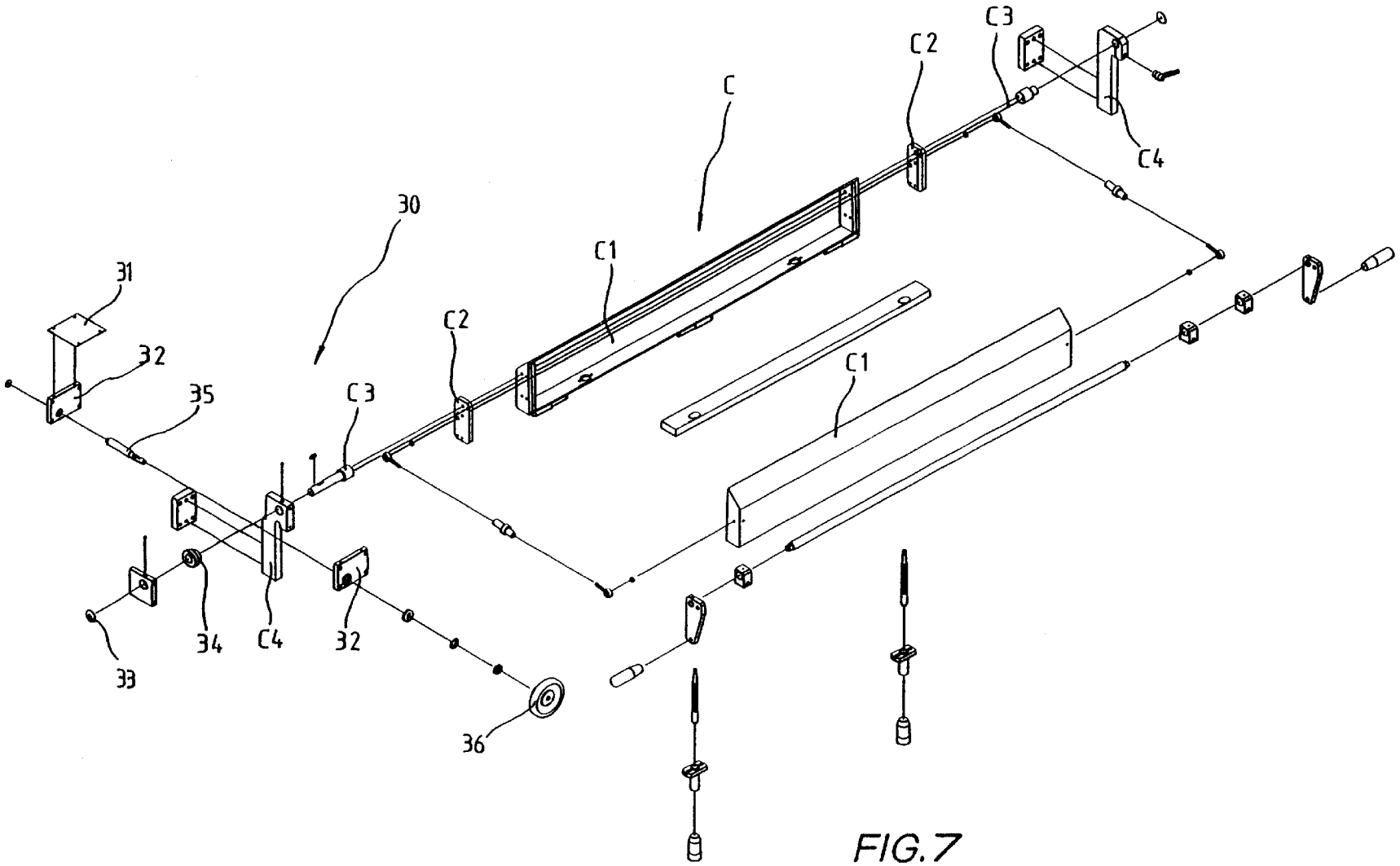
FIG. 7 is a three dimensional exposed view of a scraper holder angle adjuster of the present invention.

Please refer to FIGS. 1 and 7. A lever fixing block C2 is provided on both sides of a clipper C1 on a scraper holder C. An axis C3 is extended from each of the lever fixing blocks C2. These axes C3 rest on a rotating axis and each of them goes through a clipper fixing block C4, which serves as a support for the clipper C1. The angle adjuster 30 is provided on one side of each of the clipper fixing blocks C4 and connects to the clipper C4 to form a box support 32 with a top cover 31. The box support is not only for a better appearance, but also for filling lubricant grease. The axis C3 goes through the box support 32 and forms a sturdy axis extending from left to right. The end of the axis C3 extends out of the outer surface of the box support 32 and functions with an angle gauge 33 for angle adjustment by visual measuring of the rotating angle of the axis C3. Furthermore, the axis C3 in the box support 32 is formed with a worm wheel 34, which is coupled with a worm beam 35 that extends forward and is provided with a turn wheel 36. When in use, one can adjust the angle of the clipper holder C by simple manipulation of the turn wheel 36. So one does not need to hold and it is simple to operate.

Figure 8:
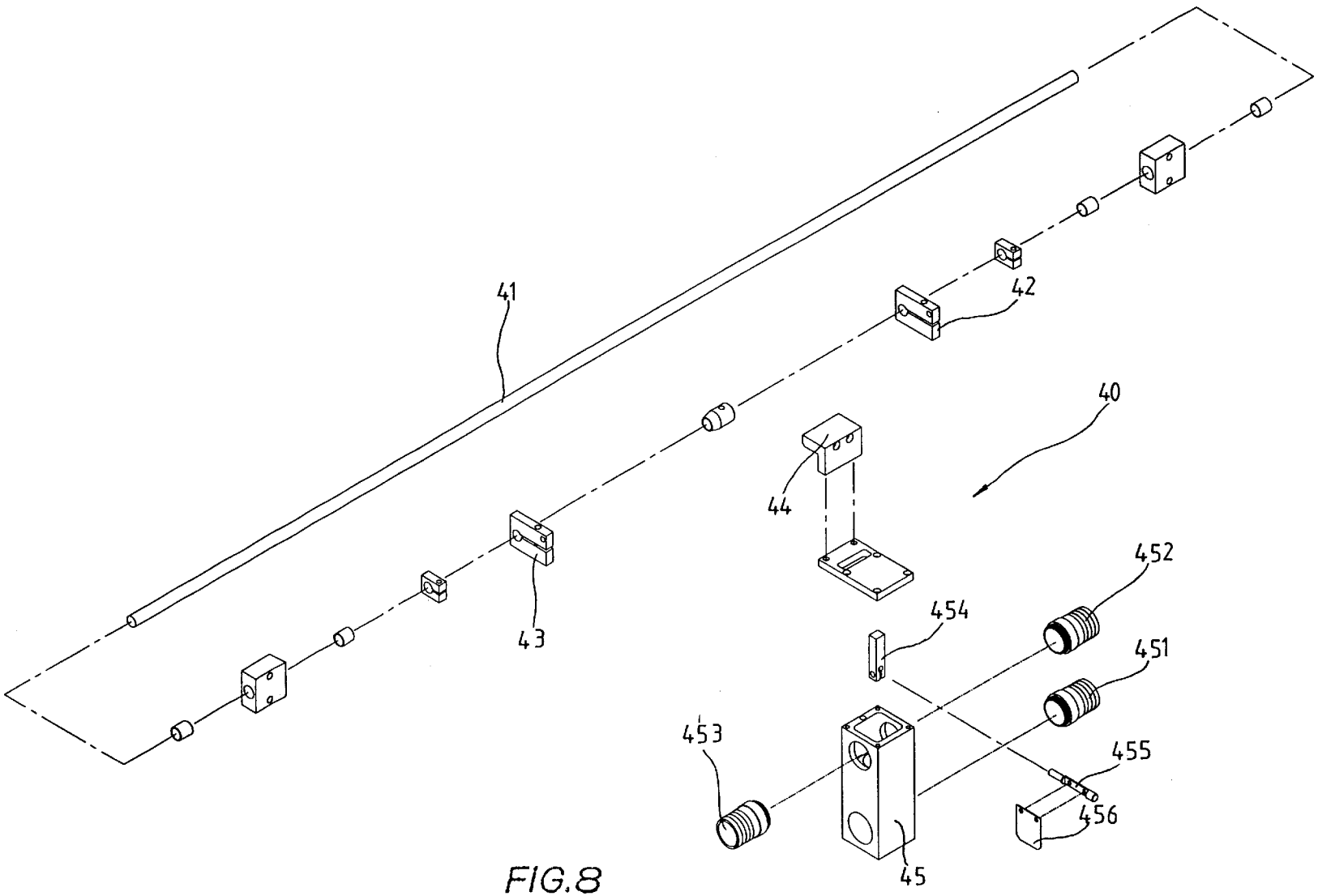
FIG. 8 is a three dimensional exposed view of an automatic switching aspirator of the present invention.
Figure 9:
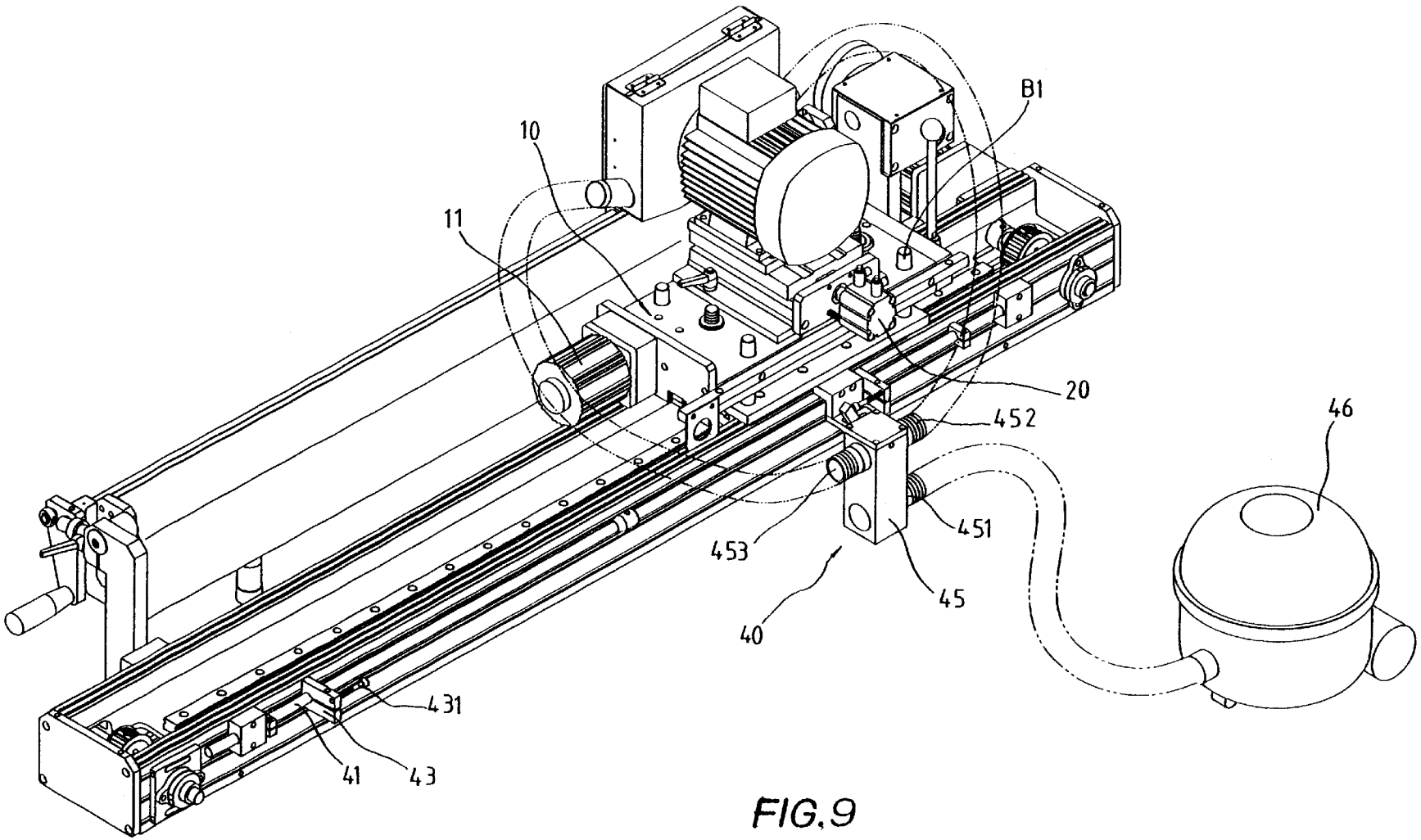
FIG. 9 is a schematic view of the action of an automatic switching aspirator at the stop end of the forward cycle according to the present invention.
Figure 10:
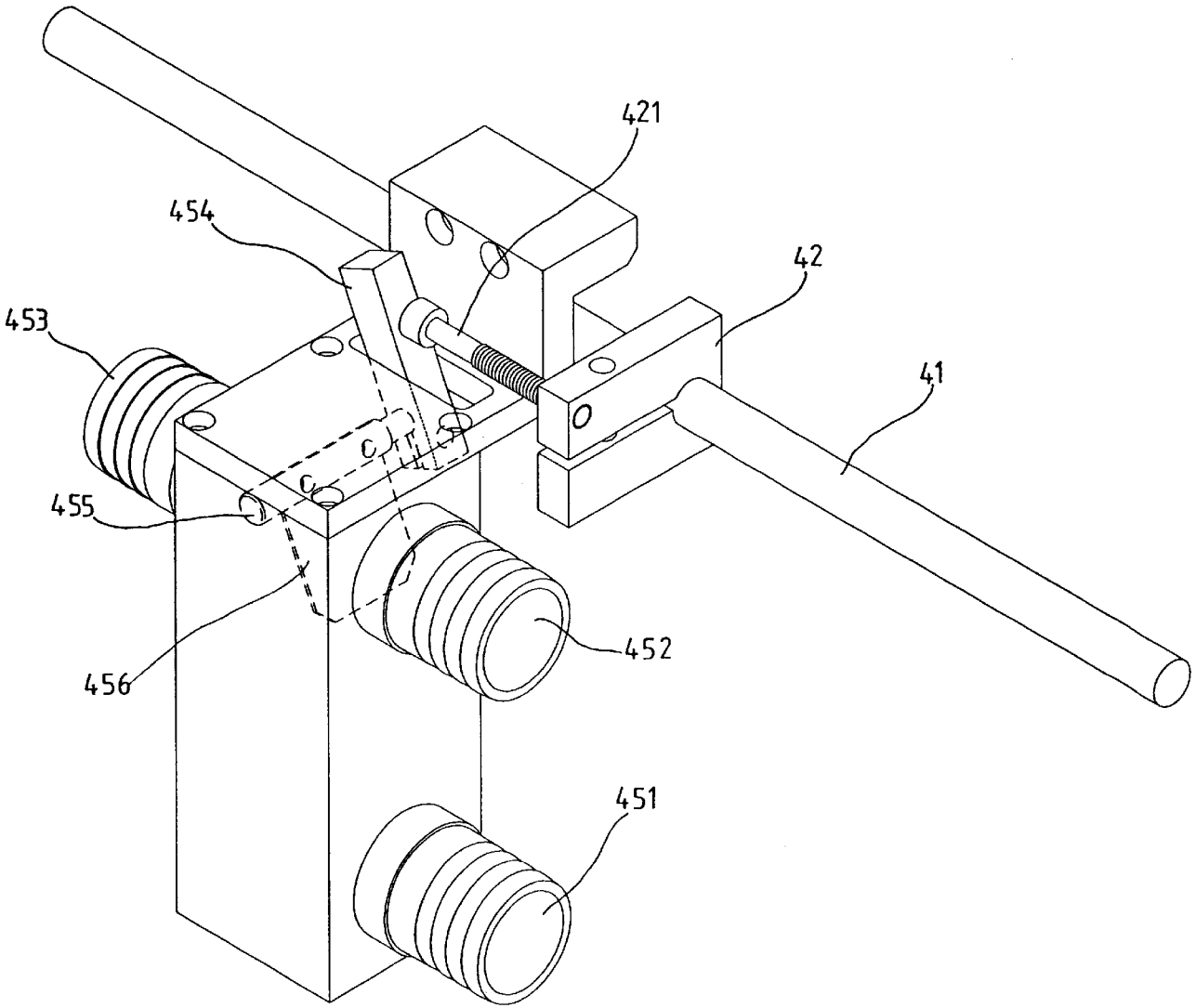
FIG. 10 is a local schematic view of FIG. 9.
Figure 11:
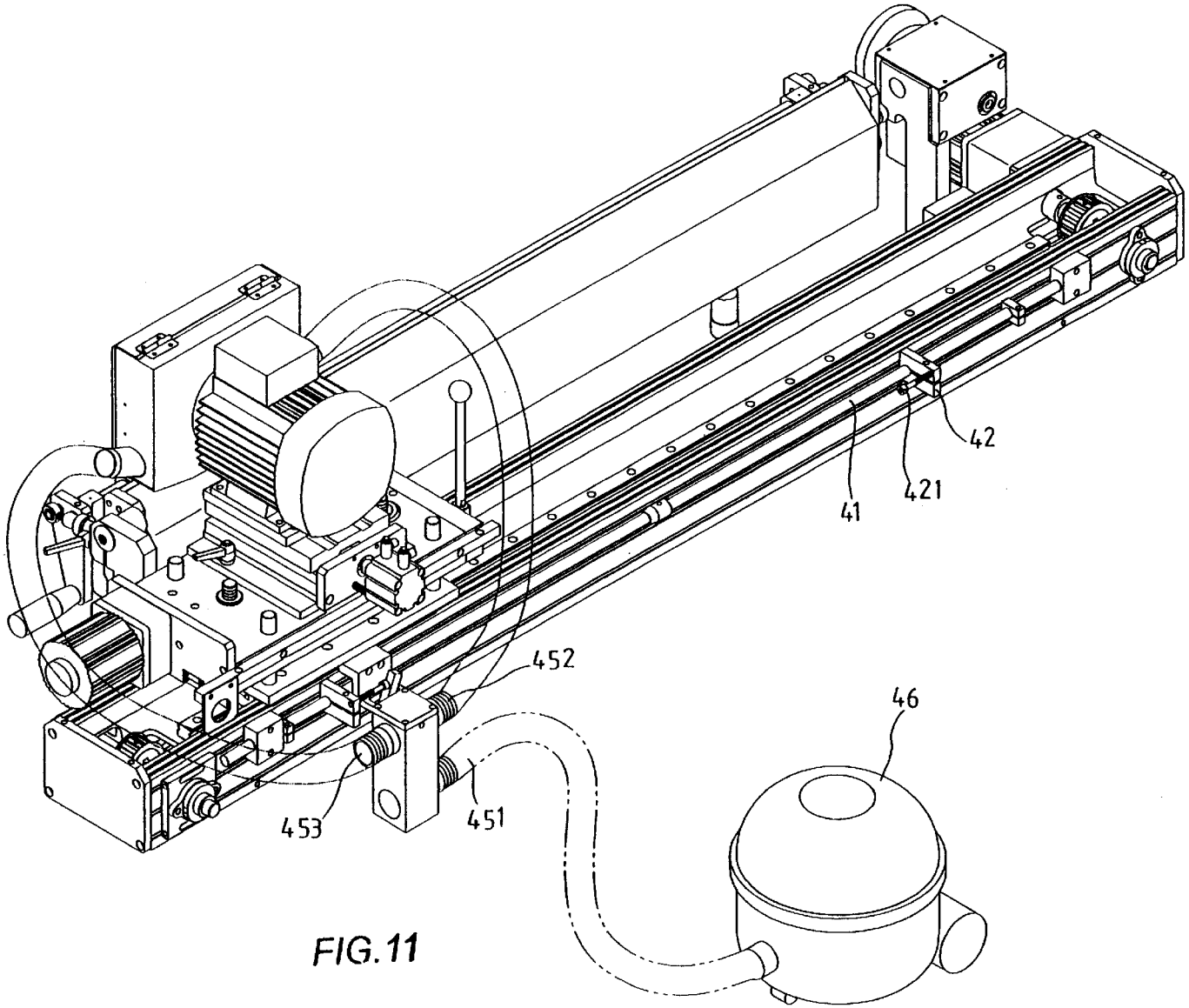
FIG. 11 is a schematic view of the action of an automatic switching aspirator at the stop end of the backward cycle according to the present invention.
Figure 12:
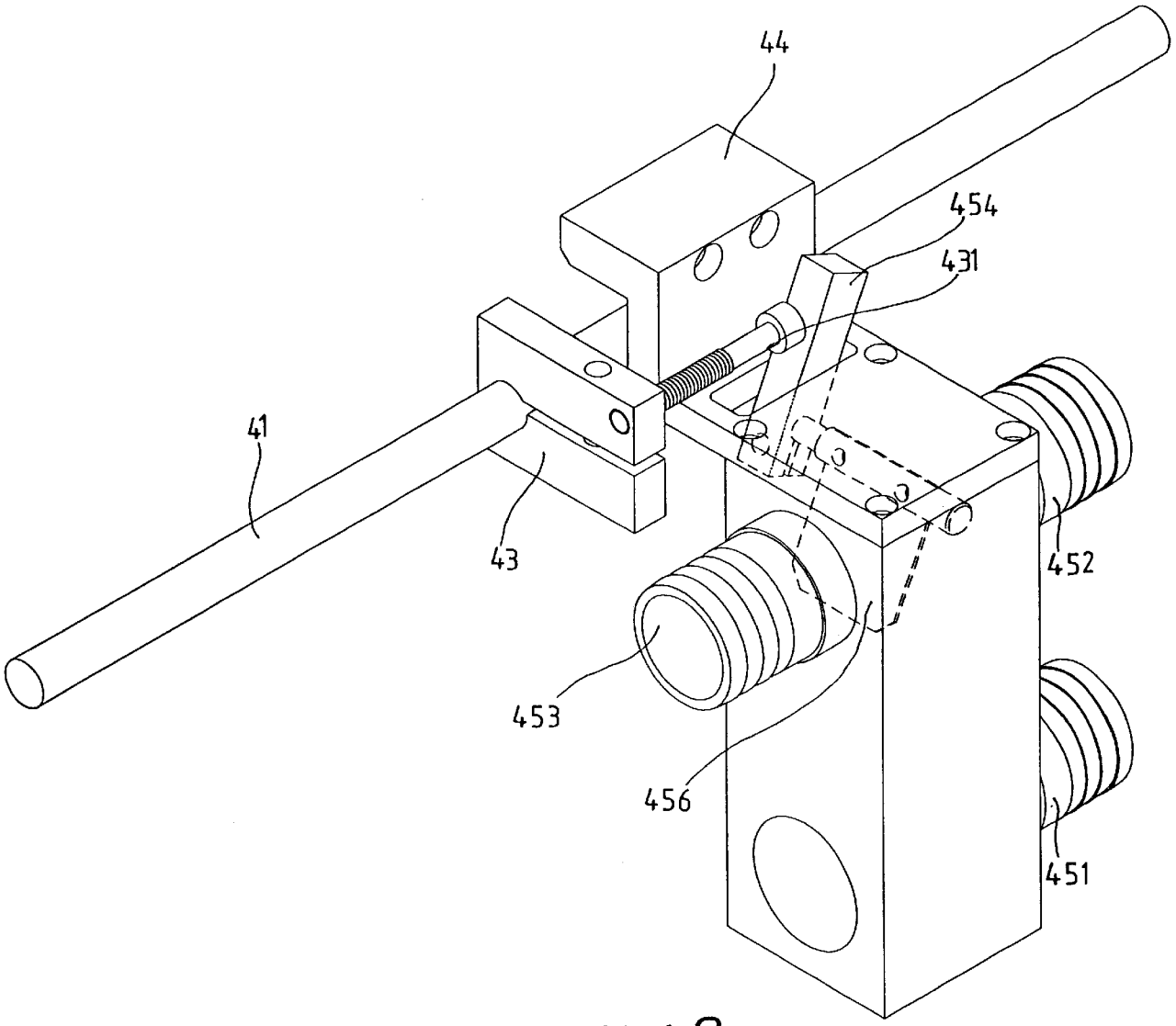
FIG. 12 is a local schematic view of FIG. 11.

Referring to FIGS. 2 and 8, the automatic switching aspirator 40 comprises a switch trigger 41, positioning blocks 42, 43 on both sides of the switch trigger 41 for adjusting the position. The position setting of the positioning blocks 42, 43 are adjusted according to the actual grinding strokes of the emery wheel base A so that they are right at the tuning points of the forward and backward grinding strokes. A reversion stick 421, 431 is provided on each positioning block 42, 43 and pointing toward the center. Furthermore, a reversion valve connector 44 sliding sideways synchronously with the emery wheel base A is also provided. A reversion valve 45 is formed on the reversion valve connector 44 and has a main pipe at the bottom and branch pipes 452, 453 on both sides of the top portion. Each of them is connected to an air pump 46 (provided in the machine) or both sides of an emery wheel mask via pipes. The top surface of the reversion valve 45 is formed with a reversion valve arm 454, which is further provided with an axis center 455 at the bottom so that the reversion valve arm 454 can rotate by the axis center 455. The axis center 455 is provided with a reversion valve chip 456 therebelow, which can cover one of the branch pipes 452 or 453 and prevent it from air leaking when the reversion valve 45 rotates. As shown in FIGS. 9, 10, 11, and 12, when the emery wheel base A moves to the right side in FIG. 9 the diamond emery wheel 60 reverses its rotation to exhaust dusts to the left, the reversion valve arm 454 is also pushed to the left by the reversion stick 421. The reversion valve chip 456 then reverses its rotation to the right to cover the branch pipe 452 so that the main pipe 451 is only in direct connection with one branch pipe 453 on single side. The main pipe can then have the full suction power on the branch pipe 453, which connects to the left side of the emery wheel mask where dusts are exhausted. Therefore, dusts can be effectively removed. When the emery wheel base A moves to the left side in FIGS. 9 and 11, the opposite actions to the upper case are then performed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fully automatic scrapper grinder, which comprises a motor and upper and lower fine tuning devices driven by said motor, an emery wheel base and a cylinder on said emery wheel base, and a front and back two-step displacement device driven by said cylinder on said emery wheel base; an emery wheel having front and back surfaces with two different sizes of emery on the front and back surfaces, a digital control system providing a set of fully automatic grinding procedures that can first roughly grind then finally grind a scraper using said digital control system; a scraper holder and a worm angle adjuster provided on said scraper holder for angle adjustment of said scraper holder; and an automatic switching aspirator formed on said emery wheel base for automatic switching of said switching aspirator in a reciprocating process of said emery wheel to effectively remove dust produced in grinding.

2. The fully automatic scrapper grinder of claim 1, wherein said set of upper and lower fine tuning devices driven by a motor is provided under said emery wheel base and in an adjustment base, which adjustment base comprises a motor disposed sideways that outputs its power to a long worm gear through a decelerator, said long work gear being on said adjustment base and rotating steadily; a beam plate, two fine tuning bolts and four beams provided on symmetrical positions on said beam plate and above said adjustment base, each of said two fine tuning bolts being coupled with a fine tuning nut that is formed with a worm wheel, extends through said adjustment base from below, and forms a single body with an O-ring and a sunny nut, wherein said two worm wheels symmetrically provided are synchronously driven along with said long work gear, and said two individual bodies composed of said fine tuning nuts, said work wheels, said O-ring, and said sunny nuts synchronously rotate about said two fine tuning bolts; and said two fine tuning bolts are fixed on said beam said two synchronously rotating individual bodies draw said adjustment base to slide up and down along said four beams, depending upon the forward and backward rotation control of said motor, said sliding of said emery wheel base being controlled using said digital control system.

3. The improved fully automatic scraper grinder of claim 1, wherein said set of front and back two-step displacement device driven by a cylinder is provided under said emery wheel base and above said adjustment base, which comprises a cylinder disposed forward on a cylinder fixing base which in turn rests on a motor adjustment base on said adjustment base, said motor adjustment base connecting to a motor sliding base via a set of tracks so that said cylinder can drive said motor sliding base to slide on said motor adjustment base steadily; said motor sliding base being fixed with said motor in said emery wheel base so that said emery wheel base can steadily slide on said motor adjustment base through the driving force of said cylinder and precisely slide forward or backward with the help of said front and back two-step displacement device and a digital control system.

4. The fully automatic scraper grinder of claim 1, wherein a diamond emery wheel is provided with two different sizes of grinding granules on the grinding surface.

5. The fully automatic scraper grinder of claim 1, wherein said angle adjuster is provided on one side of a clipper fixing block and connects to said clipper fixing block to form a box support with a top cover, said box support being formed with an axis going therethrough and forming a steady rotating axis, one end of said axis extending out of said box support and coupling with an angle gauge for visual measuring of the rotating angle of said axis, and a worm wheel being provided on said axis in said box support and coupling with a worm beam that extends forward and is provided with a turn wheel so that simple adjustment of said turn wheel can modify the angle of said scraper holder angle.

6. The fully automatic scraper grinder of claim 1, wherein said aspirator comprises a switch trigger which is provided with a positioning block on each end for adjusting positions, the position setting of said positioning block being adjusted according to the actual grinding stroke of said emery wheel base so that they are right at the turning points on both ends of said grinding strokes; a reversion stick pointing toward the center formed on each of said positioning blocks; a reversion valve connector synchronously reciprocating with said emery wheel base being; a reversion valve formed on said reversion valve connector; a main pipe at the bottom and two branch pipes on both sides the top of said reversion valve, a reversion valve arm on the top surface of said reversion valve, wherein when said reversion valve reciprocates sideways synchronously with said emery wheel base said reversion valve arm can touch said reversion sticks at stop points on both sides to automatically switch direction; a reversion valve chip formed under said axis so that when said reversion valve an moves to the left (right) and is pushed to the right (left) by said reversion stick, said reversion valve chip rotates to the right (left) and covers one of said branch pipes in that direction so as to allow said main pipe to have its full suction power on one branch pipe and a better dust removing effect.

* * * * *